US006612129B2

(12) United States Patent
Schwenk

(10) Patent No.: US 6,612,129 B2
(45) Date of Patent: Sep. 2, 2003

(54) PROCESS AND APPARATUS FOR PRODUCING KRYPTON AND/OR XENON BY LOW-TEMPERATURE FRACTIONATION OF AIR

(75) Inventor: Dirk Schwenk, Aschheim (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/284,479

(22) Filed: Oct. 31, 2002

(65) Prior Publication Data

US 2003/0110795 A1 Jun. 19, 2003

(30) Foreign Application Priority Data

Oct. 31, 2001 (DE) ..... 101 53 252
Jan. 18, 2002 (EP) ..... 02001356

(51) Int. Cl.[7] ..... F25J 3/00
(52) U.S. Cl. ..... 62/648; 62/925
(58) Field of Search ..... 62/648, 925

(56) References Cited

U.S. PATENT DOCUMENTS 4,401,448 A * 8/1983 La Clair ..... 62/925
4,568,528 A * 2/1986 Cheung ..... 62/925
5,067,976 A 11/1991 Agrawal et al.
6,314,757 B1 11/2001 Dray et al.

FOREIGN PATENT DOCUMENTS

DE 26 05 305 8/1977
DE 100 00 017 6/2000
EP 0 377 117 7/1990
EP 0 628 777 12/1994
EP 1 006 326 6/2000

* cited by examiner

*Primary Examiner*—Ronald Capossela
(74) *Attorney, Agent, or Firm*—Millen, White, Zelano, Branigan, P.C.

(57) ABSTRACT

In a process and apparatus used to produce krypton and/or xenon by low-temperature fractionation of air, compresses and clean charge air (1) is introduced into a rectification system for nitrogen-oxygen separation. The rectification system includes at least a high-pressure column (2) and a low-pressure column (3). A krypton- and xenon-containing fraction (13, 14, 15, 16) is removed from the high-pressure column (2) and introduced into the evaporation space of a condenser-evaporator (17), where it is partially evaporated. A purge liquid (26) is extracted from the evaporation space of the condenser-evaporator (17) and fed to a krypton-xenon enrichment column (24). A krypton-xenon concentrate (30) is removed from the krypton-xenon enrichment column (24). A liquid from the lower region of the krypton-xenon enrichment column (24) is introduced into a second condenser-evaporator (27), which is separate from the first condenser-evaporator (17).

21 Claims, 5 Drawing Sheets

PROCESS AND APPARATUS FOR PRODUCING KRYPTON AND/OR XENON BY LOW-TEMPERATURE FRACTIONATION OF AIR

DESCRIPTION

The invention relates to a process which is used to produce krypton and/or xenon by low-temperature fractionation of air.

The basic principles of the low-temperature fractionation of air in general and the structure of rectification systems for nitrogen-oxygen separation specifically are described in the monograph "Tieftemperaturtechnik" [Cryogenic Engineering] by Hausen/Linde (2nd Edition, 1985) and in an article by Latimer in Chemical Engineering Progress (Vol. 63, No. 2, 1967, page 35). The high-pressure column is operated under a higher pressure than the low-pressure column; the two columns are preferably in heat-exchanging relationship with one another, for example via a main condenser, in which top gas from the high-pressure column is liquefied against evaporating bottom liquid from the low-pressure column. The rectification system of the invention may be designed as a conventional double column system, but may also be designed as a three-column or multicolumn system. In addition to the columns for nitrogen-oxygen separation, there may also be further apparatus for producing other air components, in particular noble gases, for example an argon production apparatus.

A process for producing krypton and/or xenon by low-temperature fractionation of air and a corresponding apparatus are known from DE 10000017 A1. In this process, a krypton- and xenon-containing fraction, specifically the bottom liquid, from the high-pressure column of the double column for nitrogen-oxygen separation is passed, without any measures which change the concentrations, into a further column which is used to produce krypton-xenon.

DE 2605305 A shows a process and an apparatus for producing krypton and/or xenon by low-temperature fractionation of air of the type described in the introduction. In this document, the first condenser-evaporator is heated by condensing top gas from a crude argon column and, at the same time, forms the bottom heating of the krypton-xenon enrichment column. All the vapour which rises in the krypton-xenon enrichment column is produced in the first condenser-evaporator.

An object of the invention is to further improve the production of krypton and xenon, and in particular to carry out this production in a particularly economic way.

Upon further study of the specification and appended claims, further objects and advantages of this invention will become apparent to those skilled in the art.

These objects are achieved by introducing a liquid from the lower region of the krypton-xenon enrichment column into a second condenser-evaporator, which is separate from the first condenser-evaporator.

In the invention, therefore, there is a separate heat exchanger, the "second condenser-evaporator", in which rising vapour for the krypton-xenon enrichment column is produced independently of the first condenser-evaporator, and in this way relatively low-volatility constituents are concentrated further. The second condenser-evaporator is preferably designed for bottom heating of the krypton-xenon enrichment column. It may be arranged inside this column or in a separate vessel.

The second condenser-evaporator leads to a less high oxygen concentration being established in the first condenser-evaporator, so that, on account of the correspondingly reduced temperature difference, the overall size of the first condenser-evaporator can be reduced. Moreover, there is less intensive concentration of relatively low-volatility constituents in the first condenser-evaporator, which is undesirable at this location for operational reasons. Within the context of the invention, the choice of heating means for the second condenser-evaporator can be selected as desired. In principle, any suitable process fraction can be used, for example, nitrogen, perhaps from the high-pressure column, any other fraction from the high-pressure column, a partstream of the charge air or a fraction from a crude argon column which is connected to the low-pressure column, in particular crude argon from the top of a crude argon column of this type.

The "purge liquid" of the first condenser-evaporator serves as a charge fraction for the krypton-xenon enrichment column. In the present context, the term "krypton-xenon enrichment column" is understood as meaning a countercurrent mass transfer column in which a fraction which has a higher concentration of krypton and/or xenon than each of the charge fractions of this column is produced. By way of example, the krypton-xenon concentrate has a higher molar level of krypton and/or xenon than the "purge liquid" which is fed into the krypton-xenon enrichment column. This column may, for example, be designed as a transfer column, as described in DE 1000017 A1, and/or may at the same time be used to expel methane.

It is preferable for the purge liquid to be introduced in the lower region, for example directly above the bottom. In this case, a liquid is added to the top of the krypton-xenon enrichment column, in order to force the krypton which is present in the rising vapour downwards and to force methane upwards. This liquid may, for example, be removed from the high-pressure column, for example from the bottom of this column or a few plates above it. A possible alternative or additional source is the evaporation space of the top condenser of a pure argon column. In the bottom of the krypton-xenon enrichment column, the liquid flowing down can be boiled by means of a bottom evaporator. This allows the krypton and xenon contents of the krypton-xenon concentrate to be increased further. The bottom evaporator can be operated, for example, with compressed air or with compressed nitrogen from the top of the high-pressure column.

In the invention, an intermediate step, in the form of a partial evaporation in the first condenser-evaporator, may be carried out between the extraction of the krypton- and xenon-containing fraction from the high-pressure column and the feeding of this fraction into the krypton-xenon enrichment column. This step is used to concentrate krypton and/or xenon even before the krypton-xenon enrichment column is reached. As a further effect, all the other components with a lower volatility than oxygen are guided with the purge liquid out of the partial evaporation into the krypton-xenon enrichment column and are in this way kept away from other parts of the installation, in particular the low-pressure column.

The krypton-xenon concentrate which is produced in the krypton-xenon enrichment column has a krypton content of, for example, 600 to 5 000 ppm, preferably 1 200 to 4 000 ppm, a xenon content of, for example, 60 to 500 ppm, preferably 120 to 400 ppm. Otherwise, it consists mainly of oxygen and typically up to about 10 mol % of nitrogen.

The invention can particularly advantageously be implemented as part of an air fractionation plant with argon production in which an argon-containing fraction from the low-pressure column is introduced into a crude argon rectification stage. The crude argon rectification stage is used in particular for argon-oxygen separation and may be carried out in one or more columns (cf. for example EP 377117 B2 or EP 628777 B1). The cooling of the crude argon rectification stage which is in any case required is, in the context of the invention, effected by the krypton- and xenon-containing fraction, an argon-enriched vapour from the crude argon rectification coming into indirect heat exchange with the evaporating krypton- and xenon-containing fraction in the first condenser-evaporator. The partial evaporation as part of the krypton-xenon production therefore simultaneously serves to produce reflux and/or liquid product in the crude argon rectification stage.

In many cases, there is a liquid charge-air stream, for example in the internal compression of one or more products. The liquefied air is often split between high-pressure column and low-pressure column, for example by being introduced into a vessel which is arranged inside the high-pressure column and part of the liquid being removed again from this vessel and passed to the low-pressure column. Within the context of the invention, it is expedient if, instead, an oxygen-containing liquid is extracted from the high-pressure column and introduced into the low-pressure column, this oxygen-containing liquid originating from a second intermediate point, which is arranged above the first intermediate point at which the liquid charge air is introduced into the high-pressure column. This ensures that the krypton and xenon which are present in the liquid charge air flows towards the bottom of the high-pressure column and is not passed into the low-pressure column, where it would be lost to the krypton-xenon production. Moreover, other low-volatility impurities are kept .away from the main condenser. According to this aspect of the invention, the liquefied air (or an oxygen-containing liquid of similar composition) is formed by substantially krypton-and xenon-free reflux liquid of the high-pressure column.

This aspect of the invention can advantageously be applied to any process in which a fraction from the high-pressure column is fed to a krypton-xenon production stage. Its use is not limited to processes and apparatus with partial evaporation of the krypton-and xenon-containing fraction. The same applies to the corresponding further configurations.

It is preferable for there to be no mass transfer elements, i.e., plates or packing, arranged between the first intermediate point and the second intermediate point. As a result, the oxygen-containing liquid has substantially the same composition as the air, apart from the undesirable components which boil at a higher temperature than oxygen.

In the high-pressure column, there may be barrier plates, the krypton- and xenon-containing fraction being extracted below the barrier plates and an oxygen-enriched liquid being removed above the barrier plates. Therefore, the oxygen-enriched liquid contains significantly less krypton and xenon than the krypton-and xenon-containing fraction and may, for example, be passed directly into the low-pressure column and/or used to cool the top condenser of a pure argon column, without significant quantities of krypton and xenon being lost as a result. The number of barrier plates is, for example, one to nine, preferably two to six (theoretical plates).

In addition to the purge liquid, a gaseous stream can be extracted from the evaporation space of the first condenser-evaporator and likewise fed to the krypton-xenon enrichment column, for example at the same point as the purge liquid. As a result, the krypton which is still present in the evaporated part of the krypton-and xenon-containing fraction is also fed to the krypton-xenon production stage.

In the process, refrigeration can be generated by work-performing expansion of air—for example in a medium-pressure turbine—to approximately the operating pressure of the high-pressure column, which regularly involves partial liquefaction of the air. Within the context of the invention, this air which has been expanded in a work-performing manner can be fed to a phase separation, and at least part of the liquid fraction from the phase separation can be fed to the krypton-xenon enrichment column and/or the evaporation space of the first condenser-evaporator.

As an alternative or in addition, air may be expanded in a work-performing manner to approximately low-pressure column pressure, for example in a low-pressure turbine. The krypton and xenon which are present in the low-pressure air stream can be recovered if this air stream is fed to a stripping column and the bottom liquid from the stripping column is fed to the krypton-xenon enrichment column, preferably at the top or at an intermediate point a few plates below it. Moreover, the stripping column also retains other low-volatility components, such as $N_2O$, which are undesirable in the low-pressure column.

The advantages of the aspects of the invention which are associated with the work-performing expansion of air are not restricted to processes and apparatus with partial evaporation of the krypton- and xenon-containing fraction. Rather, these process steps may also be used in other processes for krypton-xenon production.

In addition, the invention relates to an apparatus for producing krypton and/or xenon by low-temperature fractionation of air comprising:

- a rectification system for nitrogen-oxygen separation comprising at least a high-pressure column (2), and a low-pressure column (3), and a charge-air line (1) for introducing compressed and precleaned charge air into the rectification system,
- a first condenser-evaporator (17),and a removal line (13, 14, 15, 16, 416) for removing a krypton- and xenon-containing fraction from the high-pressure column (2), and introducing the krypton- and xenon-containing fraction into the evaporation space of the first condenser-evaporator (17),
- a krypton-xenon enrichment column (24)and a purge-liquid line (26, 226) connected to the evaporation space of the condenser-evaporator (17) and to the krypton-xenon enrichment column (24), and
- a product line (30) for removing a krypton-xenon concentrate from the krypton-xenon enrichment column (24), and
- a second condenser-evaporator (27), separate from the first condenser-evaporator (17), wherein the evaporation space of the second condenser-evaporator (27) is in flow communication with the lower region of the krypton-xenon enrichment column (24).

According to an additional aspect of the invention, the apparatus further comprises an argon transfer line (48) connected to the low-pressure column (3) and connected to a crude argon rectification stage (18, 19), and the liquefaction space of the first condenser-evaporator (17) is in flow communication with the crude argon rectification stage (18, 19).

The entire disclosure of all applications, patents and publications, cited above and below, and of corresponding German Application No. 101 53 252.0, filed Oct. 31, 2001, and of corresponding European Application No. 02001356.1, filed Jan. 18, 2002, is hereby incorporated by reference.

BRIEF DESCRIPTION OF THE DRAWINGS

The invention and further details of the invention are explained in more detail below with reference to exemplary embodiments which are diagrammatically depicted in the drawings, wherein like reference characters designate the same or similar parts throughout the several views, and in which.

Figure 1:
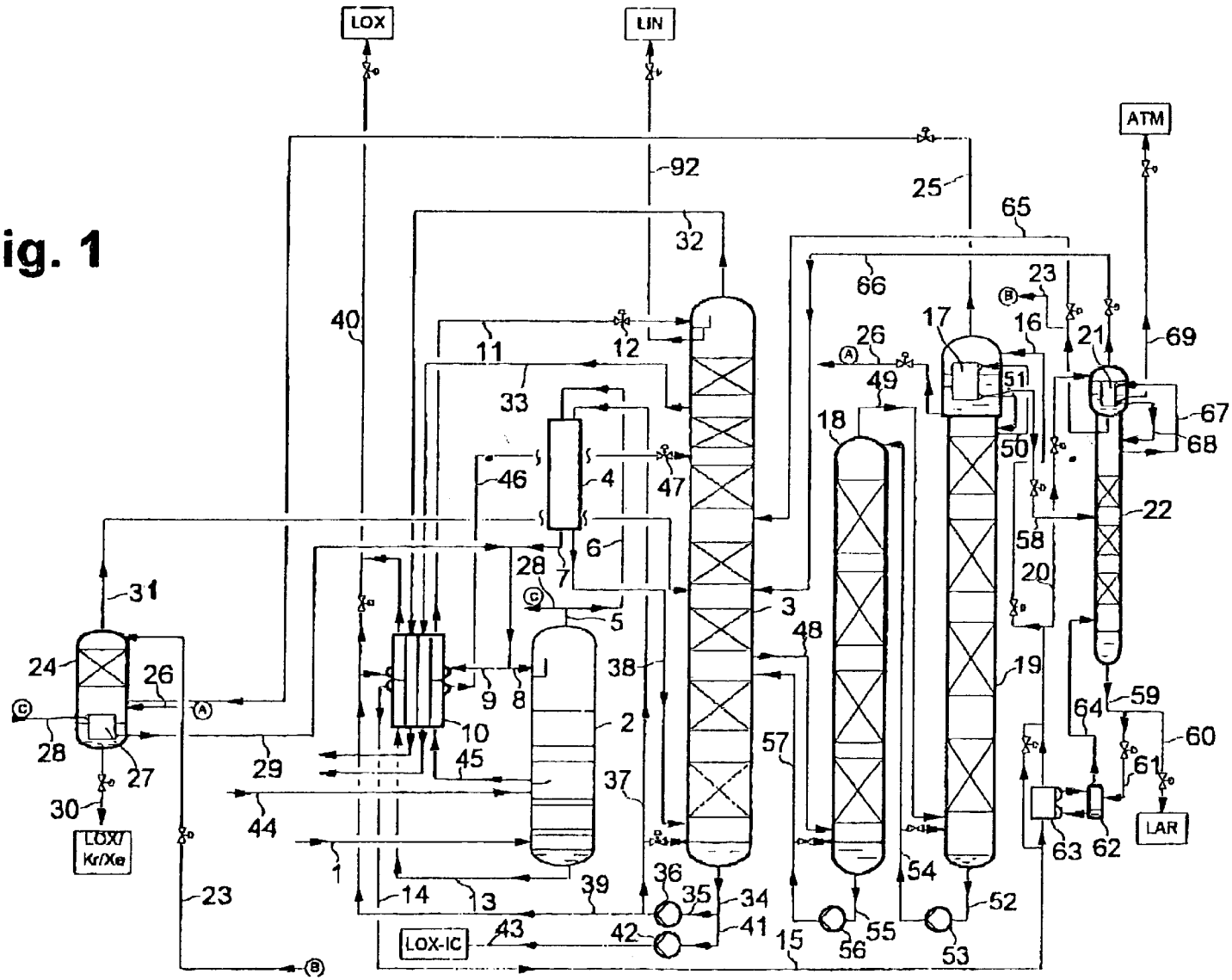
FIG. 1 shows a first exemplary embodiment of the invention.

Cleaned air which has been cooled approximately to dew point flows in gas form, via line 1 in FIG. 1, into the high-pressure column 2 of a rectification system for nitrogen-oxygen separation, which also includes a low-pressure column 3 and a main condenser 4, which in the present example is designed as a falling-film evaporator. A first part 6 of the gaseous nitrogen 5 from the top of the high-pressure column is fed to the condensation space of the main condenser 4. A first part 8 of the condensate 7 which is formed in that space is added to the high-pressure column as reflux. A second part 9 is supercooled in a supercooling countercurrent heat exchanger 10 and fed via line 11 and throttle valve 12 to the top of the low-pressure column 3. A part 92 of condensate 7 can be obtained as liquid nitrogen product (LIN).

The oxygen-enriched bottom liquid 13 from the high-pressure column 2 is likewise cooled in the supercooling countercurrent heat exchanger 10. The supercooled oxygen-enriched liquid 14 is moved onwards in two part-streams. The first part-stream 15–16 is introduced as "krypton- and xenon-containing fraction" into the evaporation space of a "first condenser-evaporator" 17, which represents the top condenser of a crude argon rectification stage 18/19. A second part-stream 15–20 is fed into the evaporation space of a top condenser 21 of a pure argon column 22.

The first condenser-evaporator 17 is designed as a forced circulation evaporator, i.e., the evaporation space contains a liquid bath in which a heat exchanger block is, e.g., partially immersed. (Preferably, the heat exchanger block is—deviating from the drawing—totally immersed in the liquid bath.) Liquid is sucked in by the thermosiphon effect at the lower end of the evaporation passages. A mixture of vapour and unevaporated liquid emerges at the upper end thereof, the unevaporated liquid flowing back into the liquid bath. The krypton- and xenon-containing fraction 16 is partially evaporated in the first condenser-evaporator 17; by way of example, 0.5 to 10 mol %, preferably 1 to 5 mol %, of the liquid 16 which is introduced is extracted in liquid form, as purge liquid 26, from the evaporation space of the first condenser-evaporator 17. This partial evaporation increases the concentration of relatively low-volatility components, in particular of krypton and xenon, in the liquid and reduces it in the vapour (in each case compared to the composition of the krypton- and xenon-containing fraction 16). The vapour produced during the partial evaporation is extracted as gaseous stream 25 from the evaporation space of the first condenser-evaporator 17. Residual liquid is discharged from the liquid bath as "purge liquid" 26 and is fed to the krypton-xenon enrichment column 24 immediately above the bottom.

The krypton-xenon enrichment column 24 has a bottom evaporator ("second condenser-evaporator") 27, which can be heated using any suitable fraction. In the exemplary embodiment, pressurized nitrogen 28 from the top of the high-pressure column 2 is used as heating means. (Alternatively, any other fraction from the high-pressure column, a part-stream of the charge air or a part of the crude argon 50 from the top of the second crude argon column 19 could be used.) The nitrogen 29 which has been liquefied in the bottom evaporator 27 is mixed with the liquid 7 from the main condenser 4. A part-stream 23 of the purge liquid from the evaporator of the top condenser 21 of the pure argon column 22 is added to the top of the krypton-xenon enrichment column 24 as reflux liquid. The vapour which rises from the bottom evaporator 27 comes into countercurrent mass transfer with the liquid 23, which contains less krypton and xenon, in the krypton-xenon enrichment column. As a result, these components are washed into the bottom, whereas most of the methane is expelled together with the top gas 31. In the present exemplary embodiment, the latter is fed to the low-pressure column 3 at a suitable intermediate point. A krypton-xenon concentrate 30 in liquid form (LOX/Kr/Xe) is removed from the bottom of the krypton-xenon enrichment column 24, this concentrate having, for example, a krypton content of approximately 2 400 ppm and a xenon content of approximately 200 ppm: otherwise, the concentrate 30 consists mainly of oxygen and also contains approximately 10 mol % of nitrogen. The concentrate 30 can be stored in a liquid tank or fed directly for further processing for the production of pure krypton and/or xenon.

In addition to the liquid nitrogen 92, pure gaseous nitrogen 32, at the top, impure nitrogen 33, likewise in gas form, and oxygen 34 in liquid form are at least in part extracted from the low-pressure column 3 as products. The gaseous products 32, 33 are heated in the supercooling countercurrent heat exchanger 10 and then further in a main heat exchanger (not shown). The liquid oxygen 34 is divided into a total of three parts. A first part and a second part are initially conveyed together via line 35 and pump 36. The first part 37 flows to the evaporation space of the main condenser 4, where it is partially evaporated. The vapour-liquid mixture 38 formed flows back to the bottom of the low-pressure column 3. The second part is extracted via the lines 39 and 40 as liquid product (LOX), if appropriate after supercooling in the supercooling countercurrent heat exchanger 10.

The third part 41 of the liquid oxygen 34 from the bottom of the low-pressure column 3 is subjected to internal compression by being brought to the desired product pressure in a pump 42, and is fed via line 43 (LOX-IC) to one or more heat exchangers, in which it is evaporated (or—in the case of supercritical product pressure—pseudo-evaporated) and heated to approximately ambient temperature. Evaporation and heating may be carried out, for example, in indirect heat exchange with a high-pressure air stream. The liquefied (or supercritical) high-pressure air is expanded (not shown) and fed as liquefied air 44 to the high-pressure column 2 at a "first intermediate point". An oxygen-containing liquid 45, the quantity of which at least corresponds to a part of the liquid air 44, is extracted from the high-pressure column at a "second intermediate point", which is arranged directly above this first intermediate point; the stream 45 may also be greater than the stream 44. There are no plates or other mass transfer elements between the first intermediate point and the second intermediate point. The oxygen-containing liquid 45, the composition of which substantially corresponds to air, after supercooling in the supercooling countercurrent heat exchanger 10 is fed into the low-pressure column 3 via line 46 and throttle valve 47.

An argon-containing fraction from the low-pressure column 3 is passed via an argon transfer line 48 into a crude argon rectification stage, which in the present example is carried out in two series-connected crude argon columns 18 and 19. The argon-containing fraction 48 is fed in gas form to the first crude argon column 18 immediately above the bottom. The argon content in the rising vapour increases. The top gas from the first crude argon column 18 flows onward via line 49 to the bottom of the second crude argon column 19.

Argon-enriched vapour (crude argon) 50 is produced at the top of the second crude argon column 19 and is largely condensed in the first condenser-evaporator 17. The liquid 51 produced is added to the second crude argon column 19 as reflux liquid. The liquid 52 which is produced in the bottom of the second crude argon column 19 is conveyed by means of a pump 53, via line 54, to the top of the first crude argon column 18. Bottom liquid 55 from the first crude argon column 18 flows back into the low-pressure column 3 via a further pump 56 and line 57.

Crude argon 58, which has remained in gas form, from the liquefaction space of the first condenser-evaporator 17 is broken down further in the pure argon column, with in particular relatively high-volatility constituents, such as nitrogen, being removed. Pure argon product (LAR) is extracted in liquid form via the lines 59 and 60. Another part 61 of the bottom liquid is evaporated in a pure argon evaporator 63 with connected separator 62 and is returned via line 64, as rising vapour, to the pure argon column 22. The pure argon evaporator 63 is heated by indirect heat exchange with at least a part of the bottom liquid 15 from the high-pressure column 2, which is supercooled in the heat exchange. As has already been described, the top condenser 21 of the pure argon column is cooled using a part 20 of this supercooled liquid. Vapour 66 and residual liquid 23, 65 are extracted from the evaporation space of the top condenser 21 and fed into the low-pressure column 3 at suitable intermediate points and/or (23) added to the krypton-xenon enrichment column 24. Top gas 67 of the pure argon column 22 partially condenses in the liquefaction space. Reflux liquid 68 which is produced in the process is added to the pure argon column. Residual vapour 69 is blown off to atmosphere.

Figure 2:
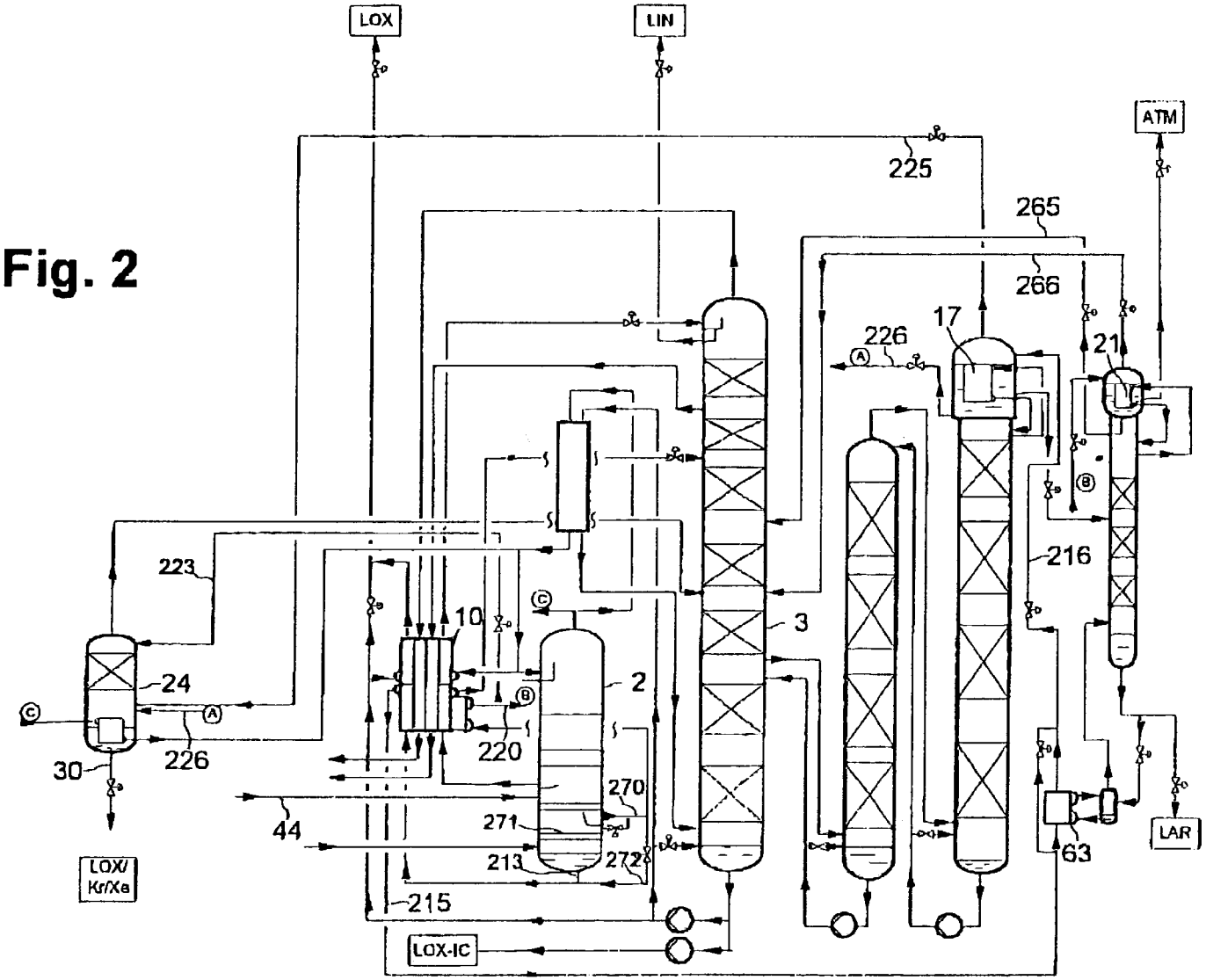
FIG. 2 shows a modification with barrier plates in the high-pressure column.

In the exemplary embodiment shown in FIG. 1, all the oxygen-enriched liquid which is produced in the high-pressure column 2 is extracted from the bottom (line 13). This allows the high-pressure column 2 to be of relatively uncomplicated structure. FIG. 2 shows a modification of this process, in which the yield of krypton and xenon is improved further. In this case, there is a further intermediate take-off for liquid 270 from the high-pressure column 2, which is separated from the bottom take-off 213 by about four barrier plates 271. These plates retain most of the low-volatility constituents, in particular krypton and xenon, in the bottom of the high-pressure column 2. As a result, the stream 270 has a significantly lower krypton and xenon content than the bottom liquid 213. A part 220 of this stream is passed via the supercooling countercurrent heat exchanger 10 into the evaporation space of the top condenser 21 of the pure argon column 22. The remainder 223 flows to the top of the krypton-xenon enrichment column 24. This results in there being a particularly low krypton and xenon content both in the fractions 265, 266 which flow out of the top condenser 21 to the low-pressure column 3 and in the reflux liquid 223. Both lead to a particularly high yield in the krypton and xenon production.

A large proportion (typically about 90 mol %) of the krypton and xenon present in the air flows together with the bottom liquid 213 via the supercooling countercurrent heat exchanger 10 and line 215, the pure argon evaporator 63, the line 216 and the first condenser-evaporator 17 and onwards via the line 225 and 226 to the krypton-xenon enrichment column 24, where it is almost completely recovered together with the krypton-xenon concentrate 30.

If necessary, a part of the liquid 270 from the intermediate take-off can be admixed with the bottom liquid 213 via the bypass line 272. By way of example, there are two to 14, preferably about five to eight, theoretical plates between this intermediate take-off and the first intermediate point at which the liquid 44 from the internal compression is introduced.

Figure 3:
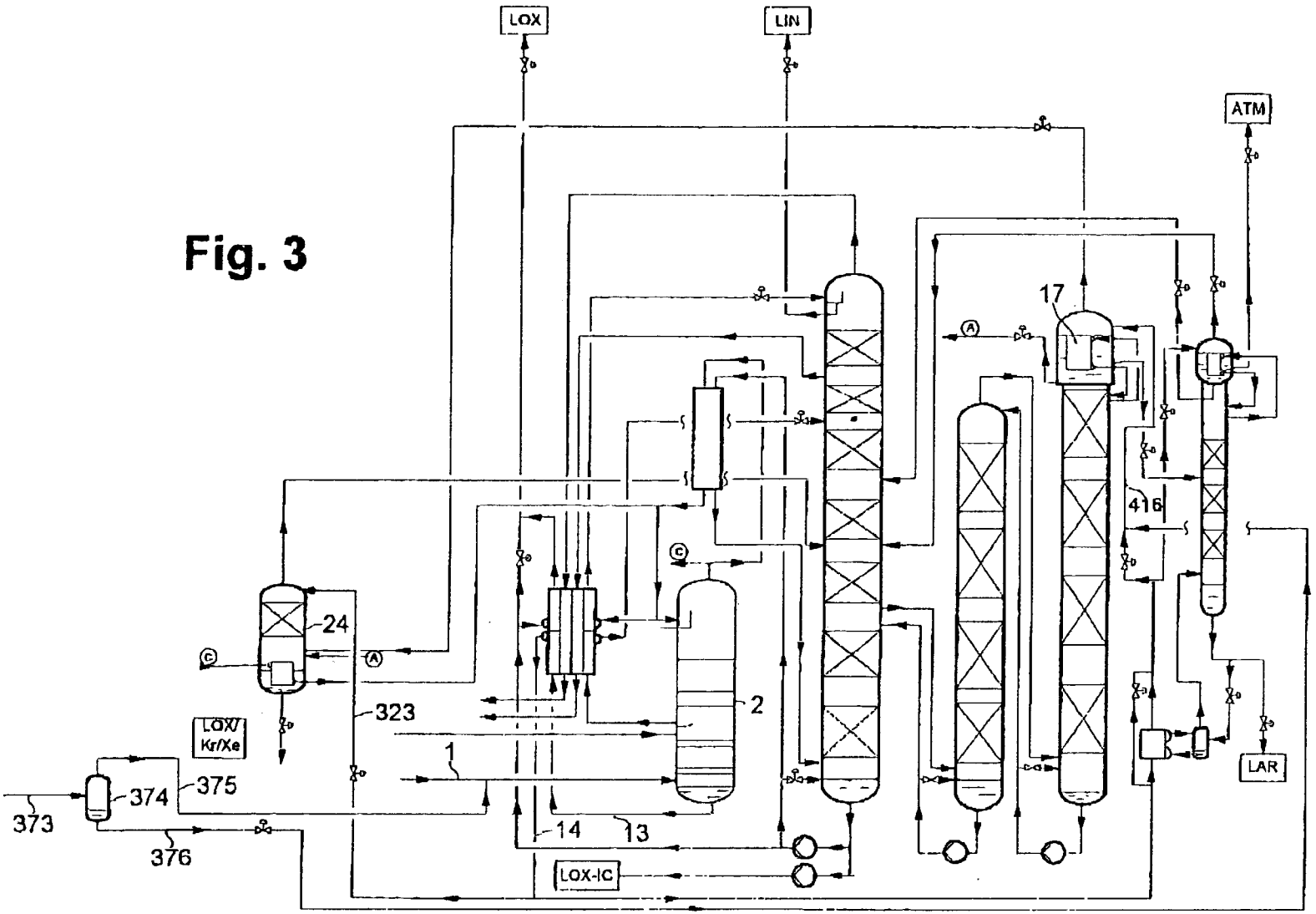
FIG. 3 shows a further exemplary embodiment with a medium-pressure turbine.

While the production of refrigeration is not illustrated in FIGS. 1 and 2, the system shown in FIG. 3 differs from that which is outlined in FIG. 1 in that the refrigeration is obtained by means of a medium-pressure turbine. The turbine itself is not shown, but rather only the part-stream 373 which comes from its outlet and is in the form of a two-phase mixture is illustrated. It is introduced into a separator (phase separator) 274. The vapour 375 from the separator 374 is, as is customary, fed into the high-pressure column 2 together with the direct air 1. The liquid 376, which has an increased level of krypton and xenon, by contrast, is introduced, together with a part of the supercooled bottom liquid 14 from the high-pressure column 2, via line 416 into the evaporation space of the first condenser-evaporator 17. Another part 323 of the supercooled bottom liquid 14 is added to the top of the krypton-xenon enrichment column 24. Of course, the additional features in FIG. 3 may also be combined with the variant shown in FIG. 2.

Figure 4:
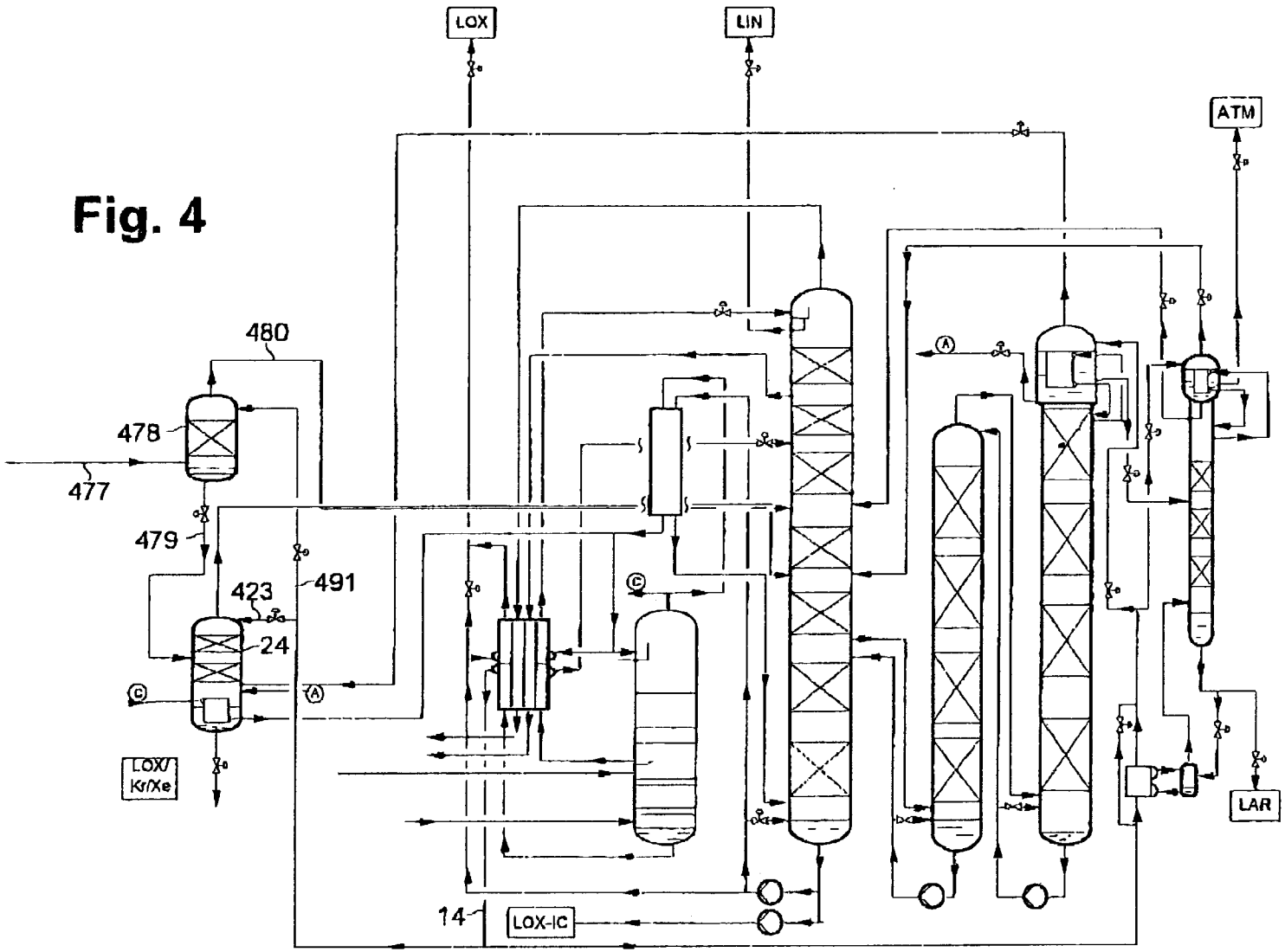
FIG. 4 shows a fourth exemplary embodiment with a low-pressure turbine.

In FIG. 4, process refrigeration is produced by means of a low-pressure turbine. The air 477 which comes from the outlet of this turbine is at approximately the operating pressure of the low-pressure column 3, but in this case is not passed directly into this column, but rather is introduced into a stripping column 478, in which the relatively low-volatility fractions are washed out into the bottom. The bottom liquid 479 is then fed to a suitable intermediate point on the krypton-xenon enrichment column 24. It forms part of the reflux liquid for the krypton-xenon enrichment column 24. Only the low-krypton and low-xenon top gas 480 from the stripping column 478 flows directly into the low-pressure column 3, in this way bypassing the krypton-xenon production. In each case a part-stream 423, 492 of the supercooled bottom liquid 14 from the high-pressure column is added to the top of the krypton-xenon enrichment column 24 and of the stripping column 478.

Figure 5:
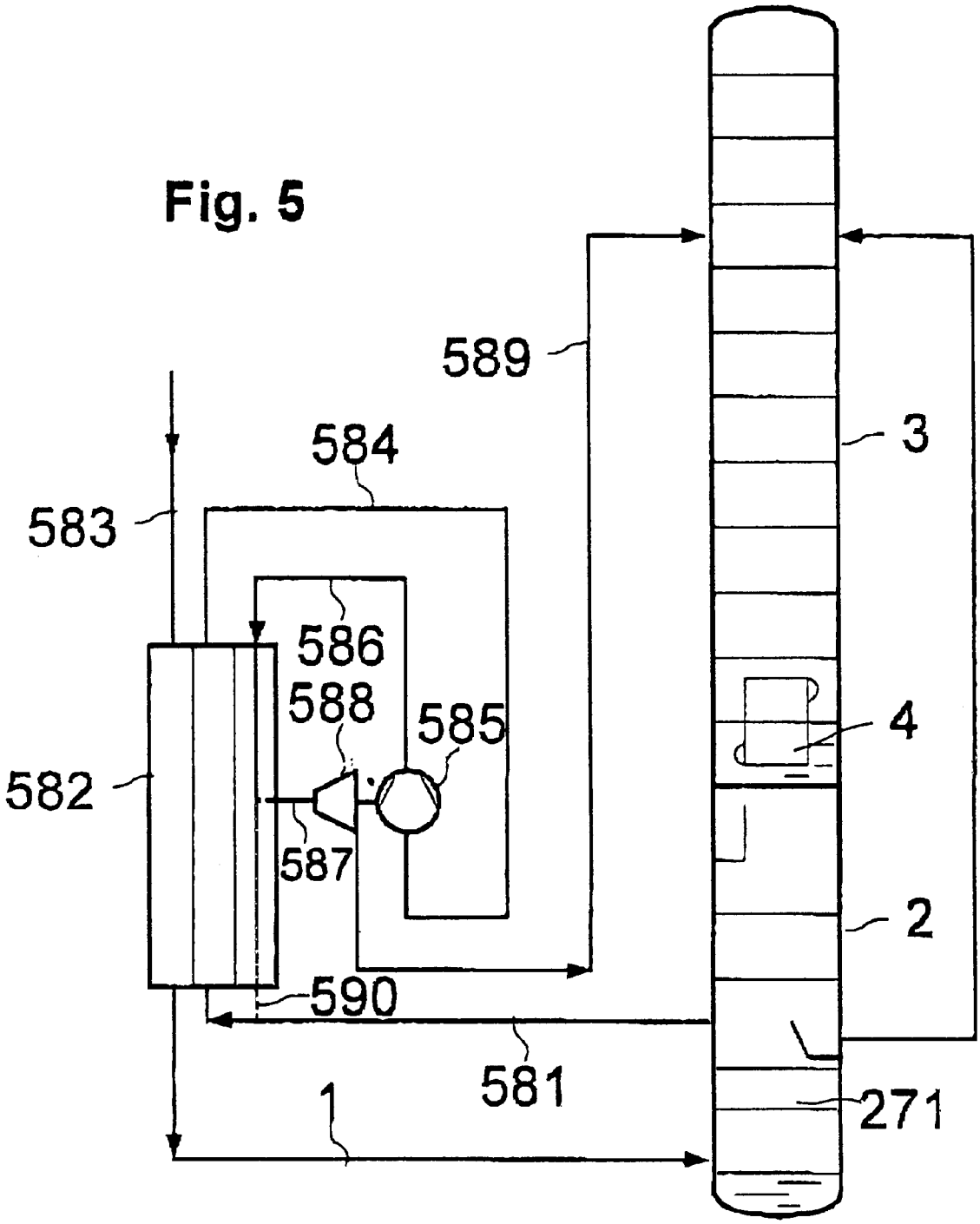
FIG. 5 shows a further variant with a turbine between high-pressure column and low-pressure column.

High-pressure column 2, low-pressure column 3 and main condenser 4 are illustrated as a double column in FIG. 5, for the sake of simplicity. In this case, refrigeration is produced by work-performing expansion of a gaseous intermediate fraction 581 from an intermediate point above the barrier plates 271. This fraction can be heated in the main heat exchanger 582 against charge air 583 which is to be cooled, can be fed to a recompressor 585 via line 584 and then passed onwards (586) to the warm end of the main heat exchanger 582. It is removed from the main heat exchanger 582 at an intermediate temperature via line 587 and is fed to the work-performing expansion 588. The turbine 588 preferably drives the recompressor 585 via a direct mechanical coupling. The stream which has undergone work-performing expansion is finally introduced into the low-pressure column 3 at a suitable point (589). Alternatively, the recompression and complete heating can be dispensed with if the stream, via the line 590 illustrated by dashed lines, is only heated to the inlet temperature of the turbine 588 in the main heat exchanger 582 and is then fed directly to this turbine (line 587).

The argon production and the krypton-xenon production are not illustrated in FIG. 5. They are carried out in the same way as in FIG. 1 or 2. In FIG. 5, there is no internal compression.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for producing krypton, xenon, or both by low-temperature fractionation of air, comprising:

introducing a compressed and cleaned charge air (1) into a rectification system for nitrogen-oxygen separation, said rectification system comprising at least a high-pressure column (2) and a low-pressure column (3), removing a krypton- and xenon-containing fraction (13, 14, 15, 16, 416) from the high-pressure column (2), introducing said krypton- and xenon-containing fraction (13, 14, 15, 16, 416) into the evaporation space of a first condenser-evaporator (17), where said krypton- and xenon-containing fraction is partially evaporated, extracting a purge liquid (26, 226) from said evaporation space of said first condenser-evaporator (17), feeding said purge liquid into a krypton-xenon enrichment column (24), removing a krypton-xenon concentrate (30) from said krypton-xenon enrichment column (24), and introducing a liquid from the lower region of said krypton-xenon enrichment column (24) into a second condenser-evaporator (27), which is separate from said first condenser-evaporator (17).

2. A process according to claim 1, further comprising removing an argon-containing fraction (48) from the low-pressure column (3), and introducing said argon-containing fraction (48) into a crude argon rectification stage (18, 19), and bringing an argon-enriched vapour (50) from said crude argon rectification stage (18, 19) into indirect heat exchange with the evaporating krypton- and xenon-containing fraction (16) in the first condenser-evaporator (17).

3. A process according to claim 2, wherein: a partial stream (44) of the charge air is fed into the high-pressure column (2) in the liquid state at a first intermediate point; an oxygen-containing liquid (45) is extracted from the high-pressure column (2) at a second intermediate point, which is arranged above this first intermediate point; and said oxygen-containing liquid (45) is introduced into the low-pressure column (3).

4. A process according to claim 3, wherein: there are no mass transfer elements between the first intermediate point and the second intermediate point.

5. A process according to claim 4, wherein there are barrier plates (271) arranged in the high-pressure column (2), and the krypton- and xenon-containing fraction (213) is extracted below said barrier plates (271), and an oxygen-enriched liquid (270) is removed above said barrier plates.

6. A process according to claim 5, wherein a gaseous stream (25, 225) is extracted from the evaporation space of the first condenser-evaporator (17) and is fed to the krypton-xenon enrichment column (24).

7. A process according to claim 6, wherein: a partial stream (373) of the charge air is expanded in a work-performing manner to approximately the operating pressure of the high-pressure column (2) and is then fed to a phase separator (374); and at least part of the liquid fraction (376) from said phase separator (374) is fed into the krypton-xenon enrichment column (24) or is fed into the evaporation space of the first condenser-evaporator (17).

8. A process according to claim 7, wherein: a partial stream (477) of the charge air is expanded in a work-performing manner to approximately the operating pressure of the low-pressure column and is fed into a stripping column (478); and bottom liquid (479) from said stripping column (478) is fed into the krypton-xenon enrichment column (24).

9. A process according to claim 3, wherein there are barrier plates (271) arranged in the high-pressure column (2), and the krypton- and xenon-containing fraction (213) is extracted below said barrier plates (271), and an oxygen-enriched liquid (270) is removed above said barrier plates.

10. A process according to claim 2, wherein there are barrier plates (271) arranged in the high-pressure column (2), and the krypton- and xenon-containing fraction (213) is extracted below said barrier plates (271), and an oxygen-enriched liquid (270) is removed above said barrier plates.

11. A process according to claim 1, wherein: a partial stream (44) of the charge air is fed into the high-pressure column (2) in the liquid state at a first intermediate point; an oxygen-containing liquid (45) is extracted from the high-pressure column (2) at a second intermediate point, which is arranged above this first intermediate point; and said oxygen-containing liquid (45) is introduced into the low-pressure column (3).

12. A process according to claim 11, wherein there are no mass transfer elements between the first intermediate point and the second intermediate point.

13. A process according to claim 12, wherein there are barrier plates (271) arranged in the high-pressure column (2), and the krypton- and xenon-containing fraction (213) is extracted below said barrier plates (271), and an oxygen-enriched liquid (270) is removed above said barrier plates.

14. A process according to claim 11, wherein there are barrier plates (271) arranged in the high-pressure column (2), and the krypton- and xenon-containing fraction (213) is extracted below said barrier plates (271), and an oxygen-enriched liquid (270) is removed above said barrier plates.

15. A process according to claim 1, wherein there are barrier plates (271) arranged in the high-pressure column (2), and the krypton- and xenon-containing fraction (213) is extracted below said barrier plates (271), and an oxygen-enriched liquid (270) is removed above said barrier plates.

16. A process according to claim 1, wherein a gaseous stream (25, 225) is extracted from the evaporation space of the first condenser-evaporator (17) and is fed to the krypton-xenon enrichment column (24).

17. A process according to claim 1, wherein: a partial stream (373) of the charge air is expanded in a work-performing manner to approximately the operating pressure of the high-pressure column (2) and is then fed to a phase separator (374); and at least part of the liquid fraction (376) from said phase separator (374) is fed into the krypton-xenon enrichment column (24) or is fed into the evaporation space of the first condenser-evaporator (17).

18. A process according to claim 1, wherein: a partial stream (477) of the charge air is expanded in a work-performing manner to approximately the operating pressure of the low-pressure column and is fed into a stripping column (478); and bottom liquid (479) from said stripping column (478) is fed into the krypton-xenon enrichment column (24).

19. An apparatus for producing krypton, xenon, or both by low-temperature fractionation of air, said apparatus comprising:

a rectification system for nitrogen-oxygen separation comprising at least a high-pressure column (2), and a low-pressure column (3), and a charge-air line (1) for introducing compressed and precleaned charge air into said rectification system, a first condenser-evaporator (17),and a removal line (13, 14, 15, 16, 416) for removing a krypton- and xenon-containing fraction from said high-pressure column (2),and introducing said krypton- and xenon-containing fraction into the evaporation space of said first condenser-evaporator (17), a krypton-xenon enrichment column (24)and a purge-liquid line (26, 226) connected to said evaporation space of the condenser-evaporator (17) and to said krypton-xenon enrichment column (24), and a product line (30) for removing a krypton-xenon concentrate from said krypton-xenon enrichment column (24), and a second condenser-evaporator (27), separate from said first condenser-evaporator (17), wherein the evaporation space of said second condenser-evaporator (27) is in flow communication with the lower region of said krypton-xenon enrichment column (24).

20. An apparatus according to claim 14, further comprising an argon transfer line (48) connected to said low-pressure column (3) and connected to a crude argon rectification stage (18, 19), and the liquefaction space of said first condenser-evaporator (17) is in flow communication with said crude argon rectification stage (18, 19).

21. A process for producing krypton, xenon, or both, comprising:

introducing a krypton- and xenon-containing fraction (13, 14, 15, 16, 416) into the evaporation space of a first condenser-evaporator (17), where said krypton-and xenon-containing fraction is partially evaporated, extracting a purge liquid (26, 226) from said evaporation space of said first condenser-evaporator (17), feeding said purge liquid into a krypton-xenon enrichment column (24), removing a krypton-xenon concentrate (30) from said krypton-xenon enrichment column (24), and introducing a liquid from the lower region of said krypton-xenon enrichment column (24) into a second condenser-evaporator (27), which is separate from said first condenser-evaporator (17).

* * * * *

UNITED STATES PATENT AND TRADEMARK OFFICE

CERTIFICATE OF CORRECTION

PATENT NO. : 6,612,129 B2
APPLICATION NO. : 10/284479
DATED : September 2, 2003
INVENTOR(S) : Schwenk et al.

It is certified that error appears in the above-identified patent and that said Letters Patent is hereby corrected as shown below:

Title page,
Item [57], ABSTRACT,
Line 2, change "compresses" to -- compressed --.

Column 12,
Line 6, change "14" to -- 19 --.

Signed and Sealed this

Twenty-seventh Day of June, 2006

JON W. DUDAS
*Director of the United States Patent and Trademark Office*